United States Patent [19]

Wunder

[11] 4,064,928

[45] Dec. 27, 1977

[54] DIE CASTING MACHINE

[75] Inventor: William G. Wunder, Hamilton, Mich.

[73] Assignee: Ex-Cell-O Corporation, Troy, Mich.

[21] Appl. No.: 745,991

[22] Filed: Nov. 30, 1976

[51] Int. Cl.[2] ..... B22D 17/10; B22D 17/24; B22D 19/00

[52] U.S. Cl. ..... 164/264; 164/312; 164/332; 164/343; 164/344; 164/DIG. 10; 164/109

[58] Field of Search ..... 164/70, 262, 264, 269, 164/303, 312, 332, 342, 343, 344, DIG. 10, 109

[56] References Cited

U.S. PATENT DOCUMENTS

| | | | |
|---|---|---|---|
| 2,335,807 | 11/1943 | Smith | 164/343 |
| 2,943,368 | 7/1960 | Peras | 22/64 |
| 3,208,113 | 9/1965 | Bennett | 164/312 |
| 3,315,315 | 4/1967 | Jriulzi | 164/303 X |
| 3,328,853 | 7/1967 | Pekrol | 164/262 |
| 3,334,378 | 8/1967 | Scherrer-Wirz et al. | 18/2 |
| 3,491,826 | 1/1970 | Potts | 164/343 X |
| 3,547,184 | 12/1970 | Kock et al. | 164/343 |
| 3,575,233 | 4/1971 | Mahle | 164/312 |
| 3,584,345 | 6/1971 | Beastrom | 164/344 X |
| 3,608,622 | 9/1971 | Bochelier | 164/303 |
| 3,667,890 | 6/1972 | Rusmini | 164/343 UX |
| 3,672,437 | 6/1972 | Bennett | 164/70 X |
| 3,866,666 | 2/1975 | Wunder | 164/327 |
| 3,881,543 | 5/1975 | Harres | 164/70 X |

FOREIGN PATENT DOCUMENTS

| | | | |
|---|---|---|---|
| 995,899 | 6/1965 | United Kingdom | 164/343 |

*Primary Examiner*—Ronald J. Shore
*Attorney, Agent, or Firm*—McGarry & Waters

[57] ABSTRACT

Die casting apparatus for casting parts such as rotors or the like comprises a three tie bar horizontally disposed die casting machine, with an indexing mechanism mounted on one of the tie bars for rotating the parts through six separate radially spaced work stations. The work stations include loading, casting, cooling, skew pin ejection, and unloading stations. The casting station includes a four plate die assembly comprising a runner plate, cover die, carrier plate, and ejector die. The die assembly employs pin-point gating and is formed such that the cast part is removed from the die and the runner system, and the runner system is ejected from the apparatus, while the part is at the casting station. A movable runner ejector plate having ejector pins ejects the runner from the runner plate. A compensating cylinder is provided for adjustment for variance in stack height. An ejector mechanism employing ejector pins removes the cast part from the ejector die so as to permit the cast part to be rotated to the next work station. Toggle linkages open and close the die assembly, with the toggle linkages being inclined inwardly at an angle of 10° with respect to the tie bars between the back plate and the traveling plate.

25 Claims, 16 Drawing Figures

DIE CASTING MACHINE

BACKGROUND OF THE INVENTION

1. Field of the Invention

This invention relates to automatic, multi-station die casting machines and more particularly to a three bar, horizontal, rotary die casting machine for casting rotors or the like.

2. Description of the Prior Art

Conventional die casting machines include stationary front and back plates and a movable plate reciprocably mounted between the two plates. The relative positions of the plates are maintained by a plurality of tie bars extending between the plates. Die halves are fastened to the front plate and the traveling plate, respectively, and the traveling plate is extended and retracted to open and close the die. When the die is closed, molten metal is injected into the die to form a part.

After the part is formed, the traveling plate is retracted and the die is opened. After the die has been opened a predetermined distance, bumper pins slidably mounted in openings in the die and traveling plate, engage a bumper plate behind the traveling plate. These pins engage and eject the part from the portion of the die attached to the traveling plate.

After the part is removed from the die casting machine, the excess metal, generally referred to as the sprue or runner system, is removed from the part in a separate pressing machine called a trim press.

A more efficient die casting machine incorporates the trimming operation in the die casting machine. In this type of machine, an indexing apparatus rotates the part between a casting station and a trimming station in the same die casting machine. For forming conventional cast parts, the cast part is usually attached to the indexing mechanism by the sprue created in the formation of the part. The part is then rotated to a trimming station where the part is removed and then to a subsequent location where the spue is removed. In die casting machines that are employed for casting parts wherein molten metal is injected into a pre-formed part body inserted into the machine, the part body is inserted into a carrier plate attached to the indexing mechanism at a loading station, and the carrier plate carries the part to the various stations.

One particular type of application involving a preformed part body is the casting of a rotor for an electrical motor. In this type of application, the part body comprises a series of circular plates or laminations connected together by a temporary skew pin inserted through an opening in center of the laminations. Die casting machines are employed for casting connector bars and end rings in the rotor assembly. The indexing apparatus first picks up the rotor body at a loading station and then moves it to a casting station where the connector bars and end rings are formed. The rotor is then carried through a cooling station, after which time the temporary skew pins are ejected from the cast rotor. Finally, the rotor is removed from the machine. At some point, the sprue or runner system is removed from the part and returned to a waste container for reuse. The entire procedure is automatic.

In most die casting machines, molten material, usually zinc, aluminum, or magnesium, is injected into the die in one of two ways. In one method, the molten metal is conveyed outwardly and injected into the side of the die cavity, leaving a runner attached to the side of the cast part. In another method, the molten metal is injected into the ends of the die cavity through inwardly tapered cone-shaped openings in the die plate, with the openings having a small diameter on the side of the die plate adjacent the interior of the die cavity. This process is called "pin-point gating" because the runner system is attached to the molded part only by means of narrow necks or "pin-points" of molded material, which can be broken away easily in removing the runner system from the cast part. Pin-point gating also provides an advantage in casting rotors in that it makes it possible to inject the molded metal directly into the die in the direction in which it will flow in molding the part.

It is an object of the present invention to provide an improved automatic die casting machine that is particularly suitable for casting rotors or stators or other such products wherein a part body is loaded into the machine and a casting is formed in the part body.

SUMMARY OF THE INVENTION

Die casting apparatus constructed in accordance with the present invention comprises at least two aligned plates, a fixed plate and a traveling plate, with the traveling plate being relatively movable toward and away from the fixed plate. An indexing mechanism is mounted between the plates for moving a part through a plurality of spaced stations, one station being a casting station. A carrier plate assembly is attached to the indexing mechanism for carrying the part to each station, with the carrier plate assembly being axially movable independent of the fixed and traveling plates. The carrier plate assembly includes a carrier plate for each station, with each carrier plate having at least one part cavity therein with open ends facing the fixed and traveling plates. A cover die mounted on the fixed plate for axial movement with respect thereto covers one end of the part cavity when the carrier plate is in the casting station and the die casting apparatus is closed. Openings or gates (preferably pin-point gates) extend through the cover die for injecting molten casting material into the interior of the part cavity. A fixed position runner plate is positioned between the fixed plate and the outer side of the cover die, with the runner plate including runner cavities in the surface thereof for conveying molten material under pressure along the outer side of the cover die to the gates. An ejector die covers the other open end of the part cavity when the die casting apparatus is closed, with the ejector die being mounted on the traveling plate. Actuation means are provided for reciprocating the traveling plate so as to open and close the die casting apparatus, such that when the die casting apparatus is closed, the runner plate, cover die, carrier plate, and ejector die are all pressed together to form a conduit for molten casting material through the runner cavities into the part cavity. An opening cylinder retracts the traveling plate from its closed position to its open position through successive first, second and third predetermined distances, with the third predetermined distance being the fully open or retracted position.

After completion of the casting operation, two cover die operating cylinders move the cover die outwardly from the runner plate along with the carrier plate and ejector die as the traveling plate begins to retract. This exposes the runner system and breaks the pin-point gates from the cast part, with the runner plate and cover die being formed so that the runner system remains attached to the runner plate when the two plates are separated. The cover die operating cylinders stop the cover die after it is moved the first predetermined distance. This stops the cover die and causes the cast part to be separated from the cover die. An ejector die ejector mechanism stops the cast part at the second predetermined distance. This causes the ejector die to be separated from the carrier plate and cast part. As the traveling plate moves outwardly, a runner ejector mechanism ejects the runner system from the runner cavity while the cover die is moved away from the runner plate.

After the cover die and ejector die have been separated from the cast part, and the traveling plate has been fully retracted, the indexing means moves the part to its next station. In subsequent stations, the part is cooled, the skew pin is removed from the center of the part, and finally the part is delivered from the die casting machine. The carrier plate is then reloaded and a new casting cycle is commenced. At each index position, a casting cycle is commenced.

In the present invention, hydraulic compensating cylinders are employed for adjusting the size of the die cavity in order to vary the depth or "height" of the die cavity without changing the die. This is of particular advantage in casting rotors or the like because the thickness or "stack height" of the rotor laminations can be varied in the same apparatus.

Molten material is injected into the part by means of a reciprocable ram that discharges molten material into the runner system through the outlet of a shot chamber. The injection process leaves solidified material at the outlet of the shot chamber (called a "biscuit") and in the runner cavities.

To remove the runner system from the outlet of the shot chamber and the runner plate after the part is formed, the ram first follows through to the end of the shot chamber and ejects the biscuit from the outlet of the shot chamber. A runner ejector plate and attached ejector pins are then moved outwardly by the cover die operating cylinder to dislodge the runner system from the runner plate.

Another feature of the present invention is an improved toggle linkage mechanism for opening and closing the traveling plate with respect to a third plate, a fixed position back plate. While toggle linkages are conventional, most die casting machines employing toggle linkages position the individual toggle linkages parallel to the tie bars and immediately inside of each tie bar in a plane extending from the tie bar to the axis of the die assembly. The same type of toggle linkages are employed in the present invention, and the structure of the toggle linkages is basically the same as conventional applications. However, the toggle linkages in the present application are positioned so as to be inclined inwardly by an angle of about 10°, as the toggle linkages extend from the back plate to the traveling plate. Thus, the points where the toggle linkages are anchored to the traveling plate are closer together than the points where the toggle linkages are anchored to the back plate. The closer position of the toggle linkages on the traveling plate locates the closing pressure more directly behind the die, while the wider spacing in the toggle linkages against the back plate minimizes deformation of the back plate as a result of the pressure applied. This position also improves the locking leverage of the toggle linkage itself.

These and other features and advantages of the present invention will hereinafter appear. For purposes of illustration, but not of limitation, a preferred embodiment of the present invention is described below and shown in the appended drawings.

BRIEF DESCRIPTION OF THE DRAWINGS

FIG. 7 shows the initial step of die opening, wherein the traveling plate has started to retract and the cover plate has separated from the runner plate.

FIG. 8 shows the second step of die opening, wherein the runner is ejected from the runner plate.

FIG. 9 shows the third step of die opening, wherein the cover plate has been separated from the carrier plate.

FIG. 10 shows the fourth step of die opening, wherein the carrier plate and cast part have been separated from the ejector die.

FIG. 11 shows the final step of die opening, wherein the ejector pins of the ejector die have been retracted away from the carrier plate and cast part.

DETAILED DESCRIPTION OF PREFERRED EMBODIMENTS

Figure 1:
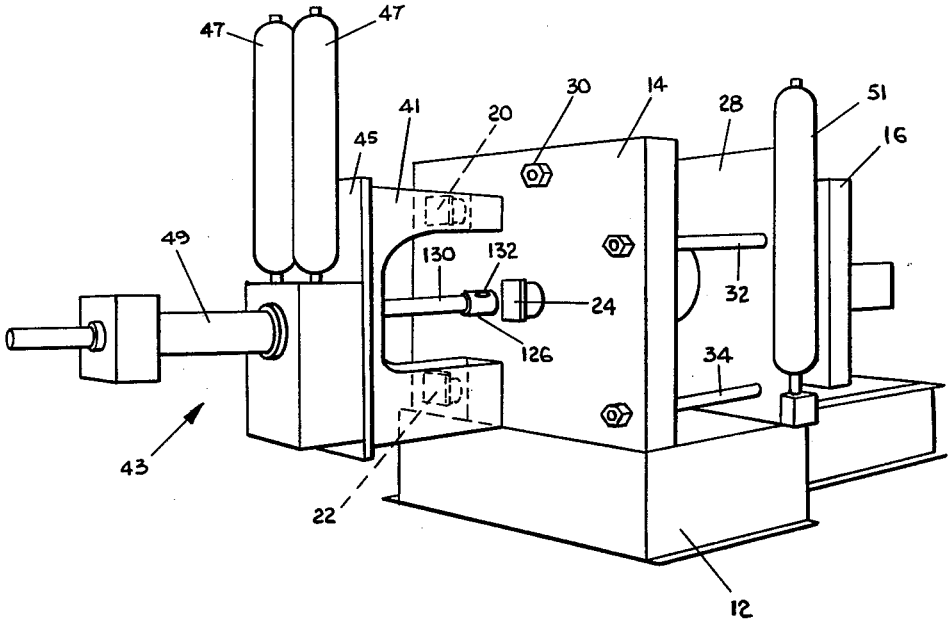
FIG. 1 is a perspective view of a die casting machine constructed in accordance with the present invention.
Figure 2:
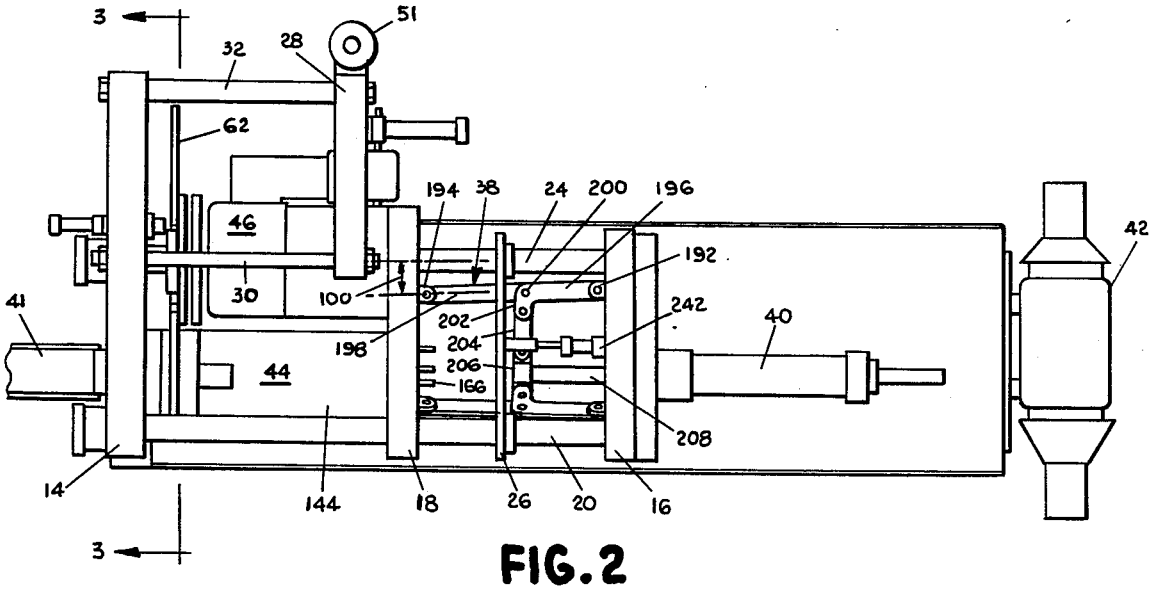
FIG. 2 is a plan view of the die casting machine shown in FIG. 1.

Referring to FIGS. 1 and 2, a die casting machine 10 constructed in accordance with the present invention comprises a base 12 and a plurality of parallel pressure plates mounted on the base. The pressure plates includes a fixed position front plate 14, a back plate 16, and a traveling plate 18 movably mounted for movement between the front and back plates. These three plates are held in spaced relationship and interconnected by means of three tie bars 20, 22, and 24, with tie bars 20 and 22 being in vertical alignment on the left side of the die casting machine (FIG. 1 orientation) and tie bar 24 being positioned in the center of the plates. A bumper plate 26 also is mounted on the tie bars and is positioned between the traveling plate 18 and back plate 16. A separate trim plate 28 is attached to the front plate by three additional tie bars 30, 32, and 34. Nuts fitting on threaded ends of all of the tie bars hold the respective plates in position and in proper alignment with each other.

Traveling plate 18 and bumper plate 26 are mounted for movement in a direction parallel to the tie bars (hereinafter referred to as "axial direction") on longitudinal rails (not shown). Traveling plate 18 is connected to the back plate by means of a toggle linkage assembly 38, which is opened and closed by means of an opening cylinder 40. Pressurized hydraulic fluid is provided to the opening cylinder by means of a hydraulic pump mechanism 42. Traveling plate 18 has a fixed stroke and moves from a retracted position wherein the traveling plate is moved away from the front plate, to an extended position when the traveling plate is moved toward the front plate. In the preferred practice of the present invention, the stroke of the traveling plate is approximately eight (8) inches.

Movement of the traveling plate effects the opening and closing of a die assembly 44 positioned between the traveling and the front plates, with one portion of the die assembly being attached to the traveling plate and another portion of the die assembly being attached to the front plate.

A C-frame bracket 41 is attached to the outside of front plate 14, and a shot assembly 43 is mounted on a vertical face plate 45 of the C-frame bracket. The shot assembly includes a hydraulically operated shot cylinder 49 that drives a reciprocable output shaft or ram 130. Ram 130 reciprocates in a cylindrical opening or shot chamber 128 (usually referred to as a so-called "cold chamber") in a cylindrical member 126 mounted in an opening in the front plate. Molten metal such as aluminum is poured into an inlet opening 132 in the cold chamber and the ram is reciprocated to force the liquid metal into a die cavity in the die assembly. Accumulators 47 store hydraulic fluid for operation of the shot cylinder. A separate accumulator 51 mounted on the outer edge of trim plate 28 provides hydraulic fluid for other hydraulic apparatus in the die casting machine.

An indexing mechanism 46 is mounted over tie bar 24 and is affixed to the traveling plate 18. A carrier plate assembly 62 is attached to the indexing mechanism. The carrier plate assembly holds the parts to be cast in the die casting machine while the carrier plate assembly is rotated through six separate stations about the axis of tie bar 24.

Figure 5:
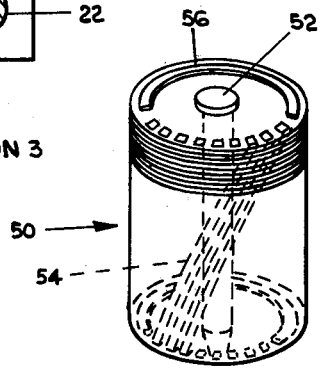
FIG. 5 is a perspective view showing a rotor that has been cast in the die casting machine of the present invention.

For exemplary purposes, the die casting apparatus of the present invention will be described in connection with the casting of connector bars and end rings in a rotor assembly for an electric motor. As shown in FIG. 5, a rotor is formed of a part body or rotor body 50 comprising a series of circular sheets or laminations of metal which are formed in a stack, with the thickness of the stack being the "stack height". The laminations are formed and stacked together so that a central opening is formed in the laminations and spiral openings are formed around the periphery of the laminations. A skew pin 52 holds the laminations together temporarily, and the die casting process fills the spiral peripheral openings with molten metal, forming connector bars 54 through the rotor. The casting process also forms annular end rings 56 on each end of the rotor.

While the present invention is particularly suited for forming connector bars and end rings in rotor assemblies, it should be understood that this is not the only use for this apparatus. The apparatus also can be used for forming stator assemblies or any other type of a cast part wherein a part body is introduced into the machine and a casting is formed in conjunction with the part body. The three bar die casting machine and indexing mechanism also can be employed for casting parts that do not have a part body.

Figure 3:
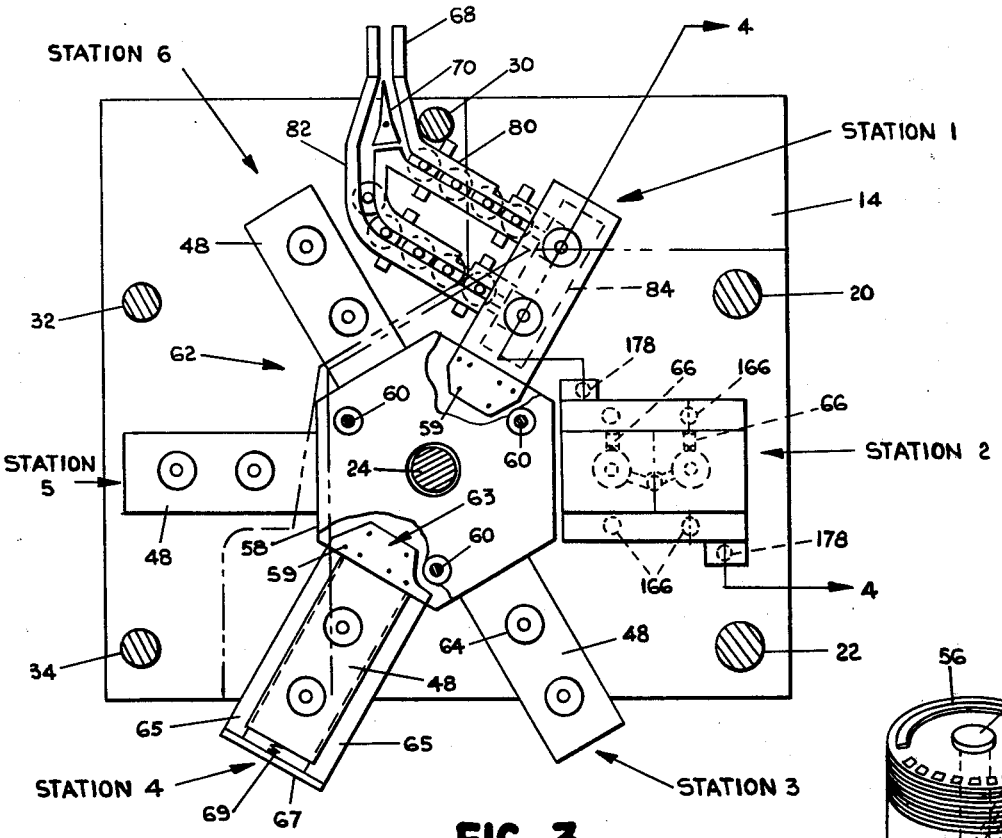
FIG. 3 is a sectional view taken along line 3—3 of FIG. 2.

The details of the indexing mechanism and carrier plate operation are shown in FIG. 3. Carrier plate assembly 62 includes a hexagonal mounting plate 58 mounted concentrically over tie bar 24 and slidably mounted on mounting rods 60 extending outwardly from the indexing mechanism for axial movement with respect to the indexing mechanism. Mounting rods 60 are rotatable by the indexing mechanism in order to rotate mounting plate 58 about the axis of tie bar 24. The indexing mechanism is constructed so as to move the mounting plate to six separate stations, each station being spaced apart an equal radial distance of 60°. Carrier plate holders 63 (shown in detail only at stations 1 and 4) are attached to each of the six sides of mounting plate 58 by suitable fasteners 59, with each carrier plate holder having a pair of spaced mounting arms 65 extending outwardly therefrom. A carrier plate 48 is inserted between the open ends of each pair of mounting arms, with the mounting arms engaging grooves in the opposite sides of the carrier plate. An end plate 67 is fastened over the open ends of the mounting arms to hold the carrier plate between the mounting arms, and a spring or other resilient biasing mechanism 69 urges the plate inwardly in the mounting arms. The reason for mounting the carrier plate in the mounting arms in this manner is that the carrier plates are subjected to substantial heating during the casting operation and, as a result, the carrier plate undergoes substantial expansion. This mounting mechanism permits such expansion without damage to the carrier plate holder.

Each carrier plate includes a pair of openings 64 for carrying rotors, with each opening containing a replaceable annular lining 71, the interior portion of which constitutes a part cavity 136 in the carrier plate. Spring mounted detents 66 (two of which are shown schematically in one of the carrier plates in FIG. 3) engage the outside of each rotor body and hold it in place in opening 64 in the carrier plate. Spring mounted detents are used only when internal connector bars are formed. When connector bars are formed in open or surface slots in the rotor body, spring mounted detents are not used.

The separate stations through which the rotor bodies are conveyed in the die casting apparatus of the present invention are shown in FIG. 3. At station one, rotor bodies are loaded into the carrier plate, with the apparatus being adapted to cast two rotors simultaneously. The indexing mechanism rotates the carrier plate 60° in a clockwise direction (FIG. 3 orientation) to station two, where the connector bars and end rings are cast into the rotor body. The die is opened and the indexing mechanism then rotates the carrier plate through stations three and four, where the parts cool. At station five, skew pins 52 are ejected from the rotor, and at station six, the rotor itself is removed from the carrier plate and conveyed from the die casting machine as a finished part. Indexing occurs in each case only after the die is fully opened and the cast part separated from the die. The operations occurring at each of these stations are described in more detail below.

Figure 4:
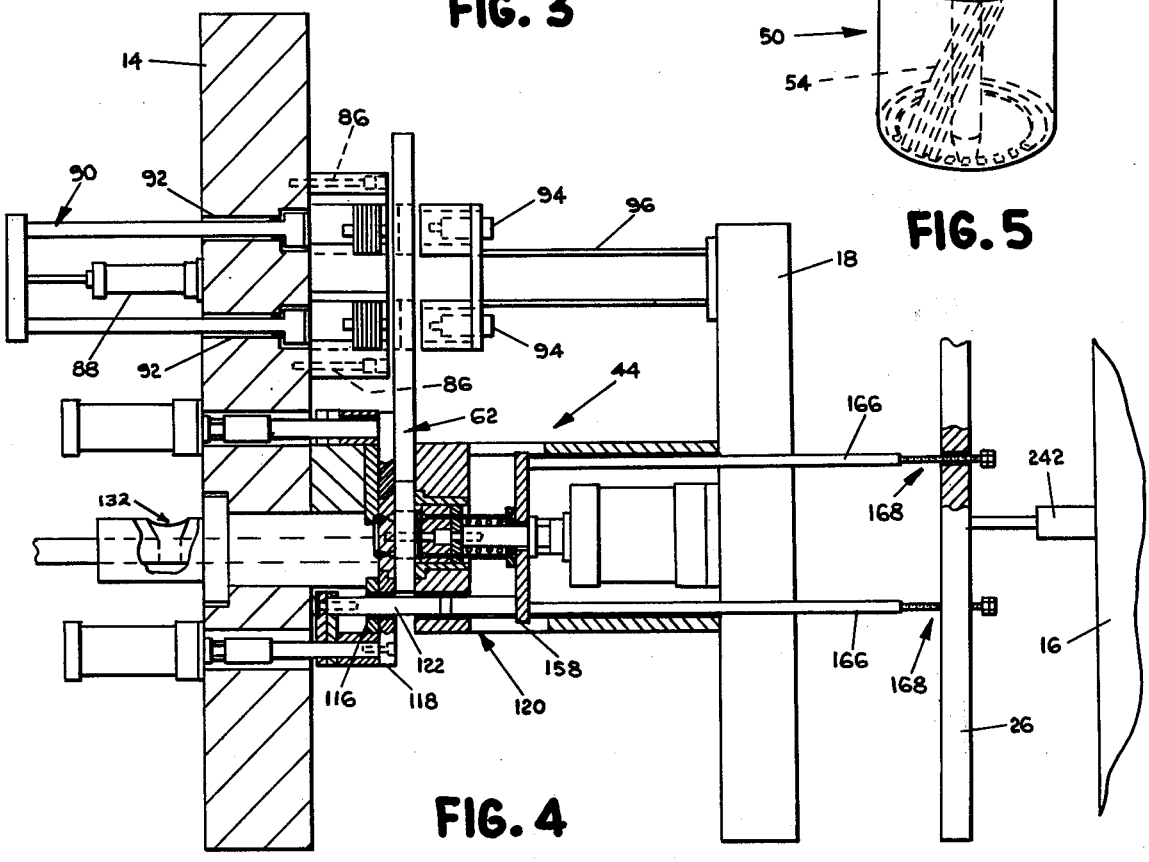
FIG. 4 is a sectional view taken along line 4—4 of FIG. 3, with the rotor and ejector die also being shown in section.
Figure 6:
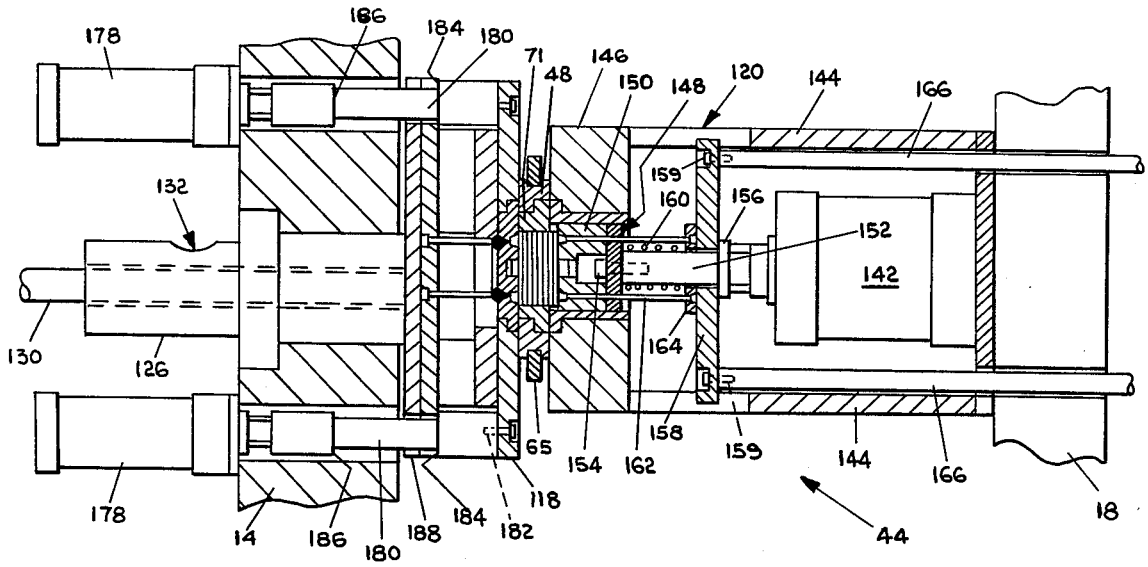
FIG. 6 is a partial side elevational sectional view showing the casting station shown in FIG. 4.
Figure 12:
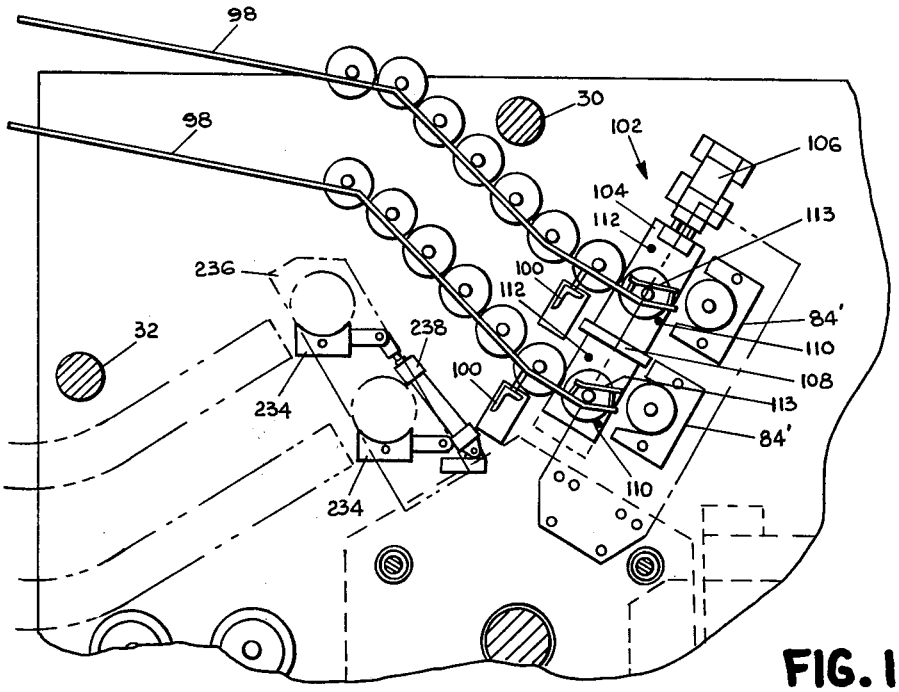
FIG. 12 is a broken elevational view of the inside of the front plate of the die casting machine, showing the rotor body loading mechanism and the cast rotor unloading mechanism of the present invention.
Figure 13:
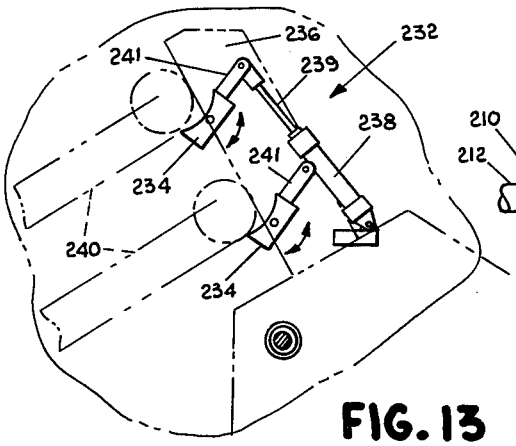
FIG. 13 is an elevational view of the rotor unloading mechanism of the present invention.

The loading operation occurring at station one is shown in FIGS. 3, 4, and 12. As shown in FIG. 3, rotor bodies 50 are conveyed to station one along a track 68 to an alternating latch mechanism 70, which pivots back and forth to direct the rotor bodies alternately into one of two outlet paths 80 and 82. Each time an empty carrier plate appears at station one, two rotors are loaded into a cradle 84, which is fastened by screws 86 or the like to the front plate (See FIG. 3). A load cylinder 88 positioned on the outer side of the front plate operates a loading ram 90 through openings 92 in the front plate to move the rotors from the cradle into the openings in the carrier plate. Proximity sensing devices 94 mounted on a bracket 96 attached to the traveling plate detect whether or not the carrier plates are loaded with rotor bodies. In the event that there is a failure to load the carrier plate with a rotor body, the proximity sensing devices prevent the carrier plate from being rotated to the casting station. This prevents malfunction of the die casting apparatus by the injection of liquid metal into a carrier plate having no rotor body.

An alternative and preferred lamination loading track 98 is shown in FIG. 12. Loading track 98 comprises two parallel tracks, instead of a single track having two outlet paths being interconnected by an alternating latch mechanism. Brackets 100 hold the tracks in position. A feed control device 102 is positioned immediately adjacent cradle mechanism 84 (which is shown as two separate cradles 84' in FIG. 12) for controlling delivery of rotor stacks to the carrier plate mechanism. Feed control device 102 comprises a slidable plate 104 that is transversely movable by means of a hydraulic cylinder 106. A strap 108 is attached to the front plate and limits movement of the slidable plate to a transverse direction. A pair of stop pins 110 and 112 extend outwardly from slidable plate 104 adjacent each loading station. Stop pins 110 prevent the rotors from leaving the track when cylinder 106 is retracted. An upper portion 113 of track 98 is positioned adjacent the tops of the skew pins and prevents the rotors from rolling over pins 110 into the cradle mechanism when the pins are in the positions shown in FIG. 12.

In order to load a pair of rotors on the cradle mechanism, cylinder 106 is extended to slide plate 104 downwardly. This moves pins 110 out of the way and permits two rotors to roll into the cradle. At the same time, pins 112 are moved into obstructing position with respect to the next rotors in line, preventing those rotors from also rolling to the loading station. When the cylinder is retracted, pins 112 move out of the way, permitting the next rotors to roll onto the loading station, and pins 110 hold the rotors in the loading station until the next carrier arm is positioned at station one.

The casting apparatus at station two constitutes one of the important features of the present invention and is disclosed in detail in FIGS. 4–11. In the plan views shown in FIGS. 7–11, only one-half of the die assembly is shown. The other half of the die assembly (for casting a second rotor) is identical to the first half and is shown in phantom as element 44 in FIG. 8.

The die assembly 44 of the present invention comprises a four plate die, including carrier plate 48, a runner plate 116, a cover die 118 and an ejector die 120. The cover die 118 is slidably mounted on cylindrical guide pins 122 extending outwardly from the front plate. Cover die 118 is affixed to the ends of cylindrical rod extensions 180. Ejector die 120 is mounted on the traveling plate, and carrier plate assembly 62 is mounted on the indexing mechanism.

Runner plate 116 is mounted in a fixed position with respect to the front plate at the outlet 124 of the cold chamber 128 (which is journaled into the runner plate) and extends all the way across the die assembly. Runner plate 116 includes a plurality of runner conduits 134 in communication with outlet 124 of the cold chamber. These runner conduits convey molten metal ejected from the cold chamber along the back of cover die 118 when the die is closed.

Cover die 118 covers one of two open ends of part cavity 136 in carrier plate 48. Cover die 118 includes a plurality of pin-point gates 138 leading from the runner conduits 134 into the part cavity. Pin-point gates 138 comprise cone-shaped openings having small outlet openings adjacent the part cavity. These openings are called pin-point gates, because when the metal forced through these openings hardens, the waste material or runner system 140 on the outside of the cover die is connected to the cast part on the interior portion of the die by means of small necks or pin-points of material. These small necks of material can easily be broken away in order to remove the runner system from the cast part. Pinpoint gating is a desirable feature of the present invention. Cover die 18 of the present invention constitutes a single plate that covers both part cavities in the carrier plate simultaneously.

Ejector die 120 of the present invention is a somewhat more complex structure, because it incorporates a hydraulic compensating cylinder 142, which makes it possible to adjust the interior volume of the part cavity to accommodate laminations having different stack heights. A separate compensating cylinder 142 is provided for each rotor cavity in the carrier plate.

Ejector die assembly 120 includes a pair of side rails 144, which are attached to the traveling plate above and below the hydraulic compensating cylinder. Side rails extend outwardly to a vertical fixed ejector die element 146 attached to the ends of the side bars by bolts or the like. Fixed ejector die element 146 has ejector die cavities 148 in the interior thereof aligned with the rotor cavities in the carrier plate. A movable ejector die element 150 fits in each ejector die cavity and is slidable with respect thereto. The ejector die cavity fits over the other open end of the carrier plate, and the movable ejector die element is movable in the ejector die cavity in order to fit against the end of the rotor conveyed by the carrier plate, even though the stack heights of different rotors may vary.

Each movable ejector die element is attached to the end of an output shaft 152 of a hydraulic compensating cylinder. A threaded fastener 154 or the like can be employed for this purpose.

Output shaft 152 of the hydraulic compensating cylinder also includes a flange 156 extending outwardly therefrom adjacent the cylinder. An ejector plate 158 is slidably mounted on the outside of the output shaft adjacent the left hand side of flange 156 (FIG. 6 orientation) of each compensating cylinder. A spring 160 or other resilient biasing mechanism is positioned around the output shaft 152 between the ejector plate and the movable ejector die element, so as to urge the ejector plate back against flange 156. Ejector pins 162 are attached by means of brackets 164 to ejector plate 158. These ejector pins extend through openings in the movable ejector die element to outer ends adjacent to the part cavity.

Ejector plates 158 are attached by threaded fasteners 159 or the like to the ends of bumper pins 166 that slidably fit through openings in the traveling plate. Bumper pins 166 extends to the back side of the traveling plate for engagement with bumper plate 26 after the traveling plate has been retracted a second predetermined distance. Desirably, the outer ends of the bumper pins 166 can be connected to the bumper plate itself by means of threaded lost motion interconnection 168, as shown in FIG. 4.

The ejector plate is maintained in alignment with the fixed ejector die element by means of a guide pin 170 extending outwardly from the ejector die plate through an opening 172 in the fixed ejector die element. This opening mates with an opening 174 in the carrier plate and opening 176 in the cover die.

Cover die 118 is moved away from runner plate 116 by means of a pair of hydraulically operated cover die operating cylinders 178 having cylinder rod extensions or extension shafts 180. The outer ends of extensions 180 are attached to the cover die by means of threaded fasteners 182 or the like. Extensions 180 include an expanded portion behind cover die 118 so as to form a shoulder 184. Another expanded portion or extension shaft 180 to the left shoulder 184 forms another shoulder 186.

Figure 11:
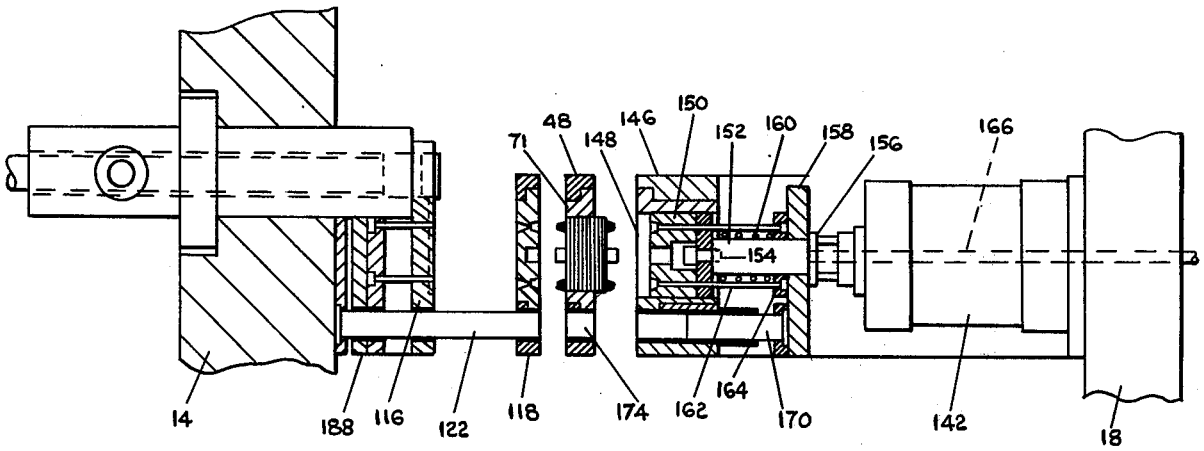

A runner ejector plate 188 is slidably mounted on guide pins 122 between the fixed position runner plate 116 and the front plate. The guide pins 122 are affixed to the front plate and project through the runner ejector plate. Guide pins 122 are positioned so that they can fit through the various openings 176, 174 and 172 in the die elements when the die is closed. The pins are short enough so that when the die is fully opened, the carrier plate is free from the pins to rotate to its next position, as shown in FIG. 11. The runner ejector plate is formed of two separate plates fastened together. Runner ejector pins 190 extend perpendicularly from the runner ejector plate through openings in runner plate 116 leading to the runner conduits.

The operation of the die assembly while the part is at the casting station is described below in connection with a description of the operation of the entire apparatus.

Figure 16:
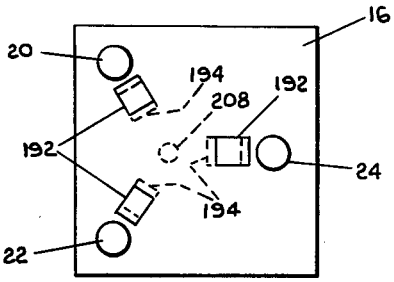
FIG. 16 is an end elevational view showing in schematic form the layout of the toggle linkages and tie bars on the surface of the back plate.

The toggle linkage mechanism 38 of the present invention is shown in FIGS. 2 and 16. One toggle linkage is provided for each tie bar, with each toggle linkage being positioned inside the tie bar and aligned toward the center of the plates. Each toggle linkage comprises an anchor 192 attached to the back plate and an anchor 194 attached to the traveling plate. A short toggle 196 is pivotably mounted to anchor 192 and a long toggle 198 is pivotably mounted to anchor 194. The long and short toggles are pivotably mounted together by a pivot pin 200. Short toggle 196 is L-shaped, having an inwardly extending portion 202. Inwardly extending portion is attached to a connecting link 204, which in turn is attached to a transverse crosshead 206 mounted on the end of output shaft 208 of opening cylinder 40. When output shaft 208 is retracted, the junction of the long and short toggles is moved inwardly and the traveling plate is retracted or withdrawn, opening the die. When the opening cylinder output shaft 208 is extended, the toggle linkages are moved to the locked position shown in FIG. 2. The various elements of the toggle linkage assembly are conventional.

In the present invention, an improved toggle linkage position is employed. Rather than mounting the toggle linkages in a conventional manner, wherein the toggle links are parallel to the tie bars when in their locked position, the ends of the toggle links attached to the traveling plate are positioned inwardly from the tie bars further than the ends of the toggle links attached to the back plate. This produces approximately a 10° inclination of the toggle linkages when locked. The inward position of the toggle links on the traveling plate serves to locate the force more directly behind the die, while the position of the toggle links with respect to the back plate minimizes the deflection of the back plate. This system adds rigidity to the machine and also increases the mechanical advantage during lockup.

Figure 15:
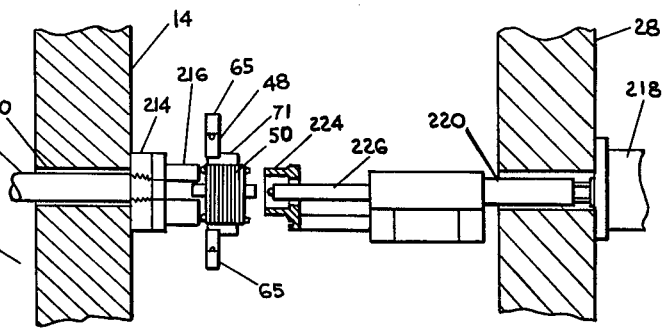
FIG. 15 is a sectional view showing the skew pin ejection mechanism of the present invention.

Station 5 of the carrier plate, wherein the skew pins are ejected, is shown in FIG. 15. At this point, carrier plate 48 is positioned adjacent an opening 210 in the front plate. A skew pin ejection tube 212 leading to a suitable receptacle (not shown) fits through this opening and screws into a mounting block 214. A support block 216, having an axial opening therein that mates with skew pin ejection tube 212, extends outwardly from the mounting block into position to support the rotor and carrier plate while the skew pin is ejected from the center of the rotor. A skew pin eject cylinder 218 is mounted on the outer side of the trim plate, with an output shaft 220 thereof extending through an opening in the trim plate. The outer end of the output shaft is fitted with an annular cup-shaped element 224 that rests against the side of the rotor and steadies the rotor while the skew pin is being ejected. A skew pin eject rod 226 fits through cup 224 into contact with the skew pin. When cylinder 218 is actuated, the cup moves outwardly into contact with the rotor and then the skew pin eject rod 226 drives the skew pin from the rotor into skew pin ejection tube 212.

Figure 14:
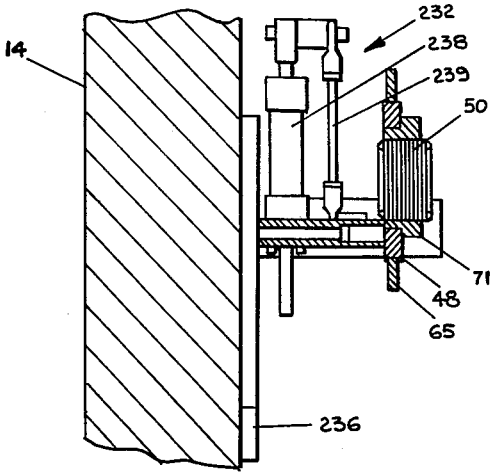
FIG. 14 is a sectional side view showing the rotor unloading mechanism of the present invention.
Figure 14:
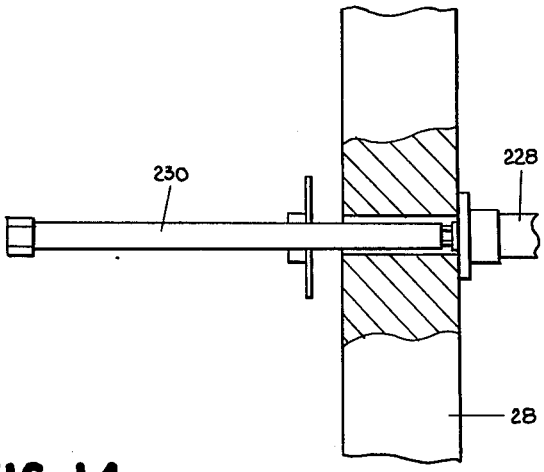

After the skew pin has been ejected from the rotor and the skew pin eject rod has been withdrawn from the rotor, the carrier plate moves to the sixth station, at which point the finished rotor is removed from the die casting machine. This apparatus is shown in FIG. 14.

At station six, carrier plate 48 is positioned opposite a rotor eject cylinder 228 having an output shaft 230 positioned adjacent the rotor for engagement therewith. A pivotable cradle mechanism 232 is positioned on the opposite side of the rotor. Cradle mechanism 232 comprises a pair of tiltable rotor cradles 234 pivotably mounted to a base plate 236, which is in turn attached to the inside surface of the front plate. Extension of output shaft 230 pushes the completed rotor from the carrier plate onto rotor cradles 234. Actuation of a cradle tilt cylinder 238 extends an output shaft 239 attached to rotor cradles 234 by arms 241 and causes the rotor cradles to tip. As a result, the rotors roll from the rotor cradles into output chutes 240 which convey the completed rotors away from the die casting machine.

OPERATION

The operation of the die casting apparatus of the present invention can be described as follows. The rotor bodies are loaded into the carrier plate at station one and the carrier plate is rotated to station two for the casting operation. When the carrier plate arrives at station two, the traveling plate is actuated and closed by its full stroke of eight (8) inches. This causes the runner plate, cover plate, carrier die, and ejector die to be pressed together. A conduit is thus formed from the interior of the cold chamber through the runner conduits and pin-point gates to the interior of the part cavity. At this point, molten metal is introduced into the cold chamber and the ram is actuated to force the molten metal through the runner system into the interior of the part cavity. Preferably, the ram has a sixteen (16) inch stroke, which is capable of extending the outer end of the ram through the end of the cold chamber to position 130″ (see FIG. 7). Initially, however, the ram movement is stopped short of this point, as shown by stopping line 130′ in FIG. 7 so that enough metal is available in the end to the shot chamber to compensate for shrinkage occurring during the cool down to the part. At this point, the traveling plate is retracted. As the traveling plate is separated, the die assembly is separated in a series of steps.

In the first step, as the traveling plate begins moving back, the cover die operating cylinders 178 are actuated to continue to press the cover die against the carrier plate as the carrier plate moves away from the front plate. This causes a first parting line to form between the runner plate and cover die. This separates the runner system from the rotor at the pin-point gates, breaking the pin-point gates from the rotor. The runner system remains attached to the runner plate at this point.

Figure 7:
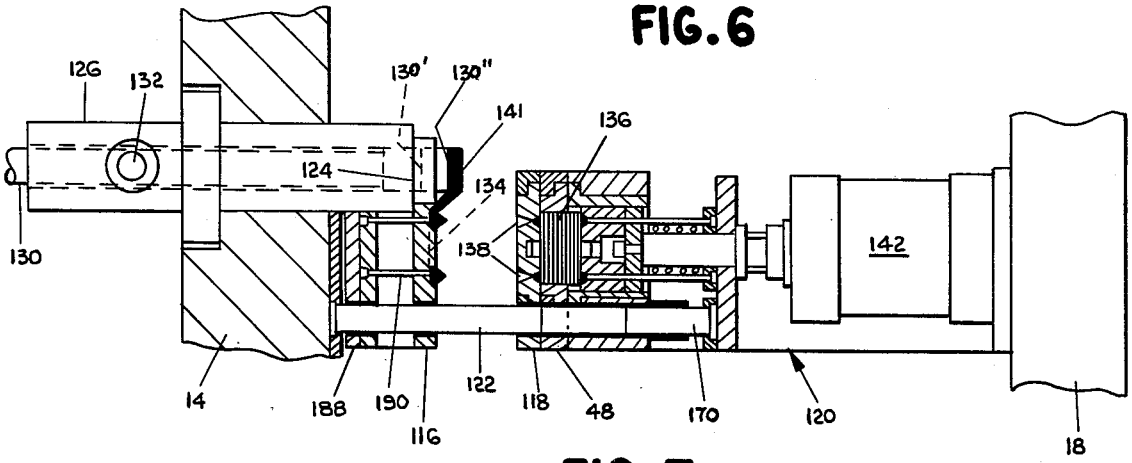
FIGS. 7–11 are sectional plan views showing the sequential operation of the die casting apparatus at the casting station. The casting operation is shown only with respect to one of the two rotors cast simultaneously at that station.

When the parting line is preferably about two inches wide, the ram in the cold chamber completes its stroke through the end of the shot cylinder to position 130″, thus pushing the portion 141 of the metal at the outlet of the shot cylinder (commonly referred to as the "biscuit") from the cold chamber and bending the metal runner 140 outwardly. This state is shown in FIG. 7.

Figure 8:
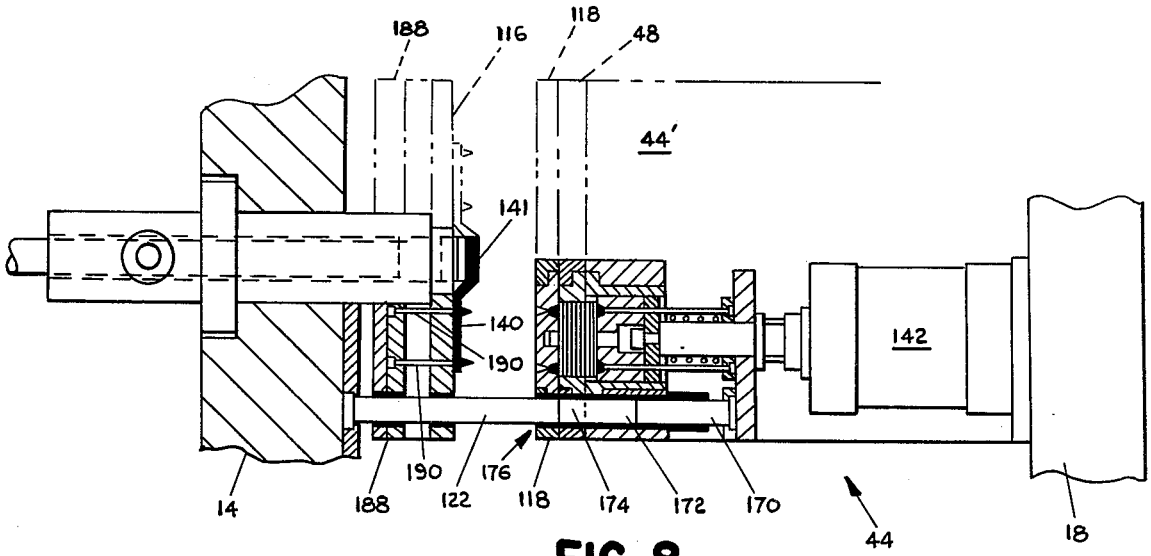

When the die has opened a distance of preferably three and one-half (3½) inches, shoulders 186 on the extension shafts of the cover die operating cylinders come into contact with the runner ejector plate. This causes the runner ejector pins to engage the runner system and dislodge the runner system from the runner plate, as shown in FIG. 8. The biscuit and attached runner system are then dropped free of the runner plate and cover die to an appropriate receptacle for remelting.

The cover die operating cylinders have a limited stroke, preferably four (4) inches. The cover die stops when these cylinders reach the end of their stroke. This distance is referred to above as the first predetermined distance.

Figure 9:
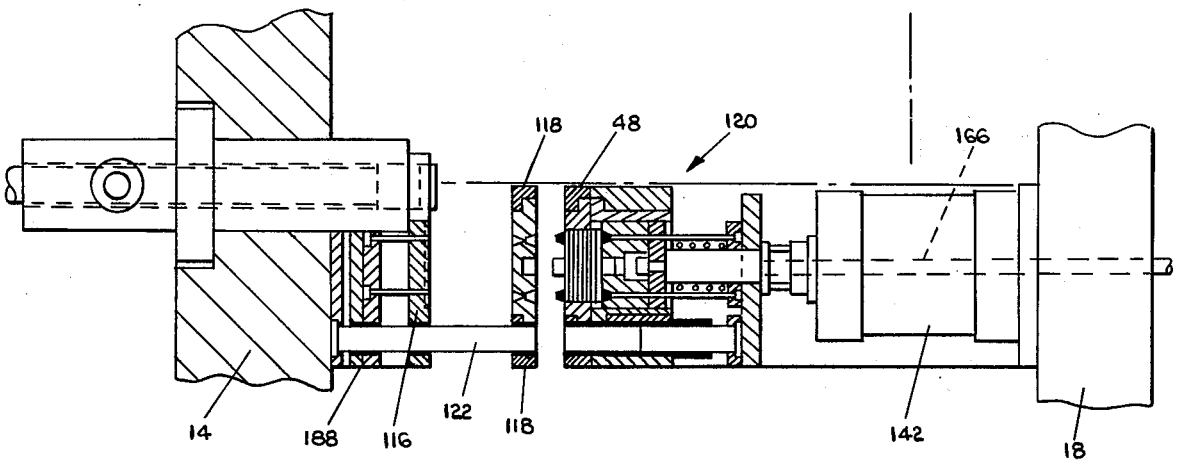
Figure 10:
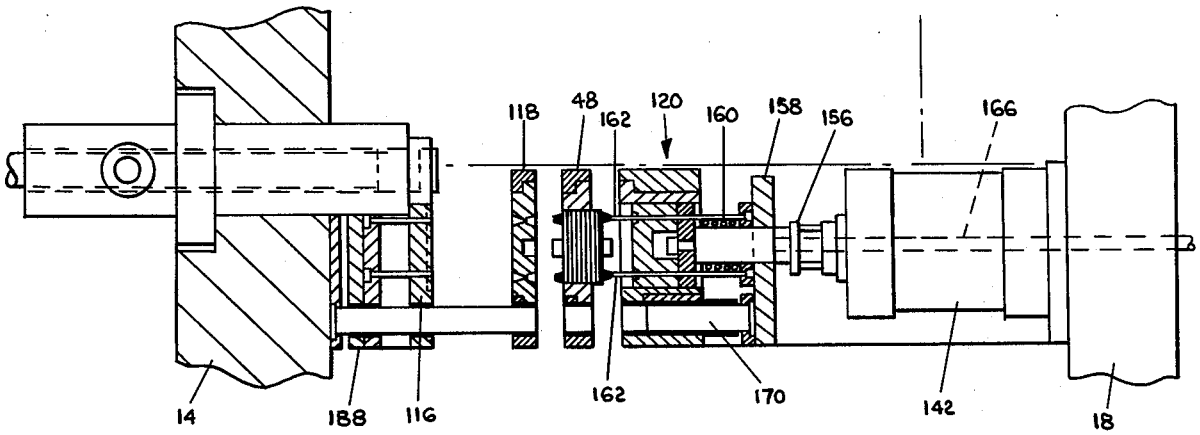

When the cover die stops and the traveling plate continues to retract, a second parting or separation line is created between the cover die and the carrier plate, which continues to move with the ejector die. This is illustrated in FIG. 9.

The carrier plate and ejector die continue to move with the traveling plate for preferably one (1) inch more. At this point, bumper pins 166 engage hydraulic bumper plate 26, which is held in a fixed position with respect to the traveling plate by a bumper plate operating cylinder 242 extending between the back plate and bumper plate. In the preferred practice of the present invention, a plurality of bumper plate operating cylinders are employed for this purpose, not just the single cylinder shown schematically in the drawings.

When the bumper pins engage the bumper plate, the bumper pins stop the ejector plate from further movement in a backward direction. As the traveling plate continues to move backwardly, each ejector plate 158 overcomes the resilient force of spring 160 and moves away from flange 156 on the output shaft of the hydraulic compensating cylinder. The relative movement between the ejector plate and the ejector die causes the ejector pins to protrude outwardly into contact with the rotor, in the manner shown in FIG. 10. This results in the separation of the ejector die from the carrier plate and cast rotor. This occurs at the distance referred to as the second predetermined distance.

The bumper plate operating cylinder at this point is in an extended position. After the traveling plate has traveled a distance sufficient to permit the carrier plate to be completely clear of the ejector die, preferably a total of six (6) inches from the closed position, the hydraulic bumper plate operating cylinder is retracted in the manner shown in FIG. 11 in order to retract the bumper plate backwards by a distance of preferably three (3) inches. This allows the ejector plate and ejector pins to move back to their normal positions in the ejector die and clear the carrier plate from the ejector pins.

The traveling plate with the attached ejector die continues to open to the total distance of eight (8) inches (i.e., the third predetermined distance). The index unit is then allowed to rotate 60° to carry the cast part to the next station.

Each time a carrier plate carrying cast rotors moves out of the casting station, a new carrier plate is moved into the casting station. To cast another part, the traveling plate is extended and the die is closed, moving the cover die and runner ejector plate back to their original positions and retracting rod extension 180. A new cast part can then be formed.

As described above, in stations three and four, the part cools. In station five, the skew pins are ejected, and in station six, the rotor is removed from the carrier plate and conveyed on an outlet chute from the die casting machine. The empty carrier plate then moves to the loading station to receive new rotor bodies for casting.

It should be understood that the foregoing is merely exemplary of the preferred practice of the present invention and that various changes and modifications may be made in the arrangement and details of construction of the elements disclosed herein without departing from the spirit and scope of the present invention.

I claim:

1. Die casting apparatus for casting a part comprising:

a pair of opposed pressure plates, one plate being a fixed plate and the other plate being a traveling plate, the traveling plate being relatively movable in an axial direction toward and away from the fixed plate to close and open the die casting apparatus;

indexing means mounted between the plates for moving the part through a plurality of separate stations, one station being a casting station;

carrier plate means mounted on the indexing means for conveying the part to each station, the carrier plate means being axially movable independent of the fixed and traveling plates, the carrier plate means having a part cavity therein with open ends facing the fixed and traveling plates;

cover die means mounted on the fixed plate at the casting station for axial movement with respect to the fixed plate, the cover die means having an inner side facing the traveling plate and an outer side facing the fixed plate, the cover die means covering one end of the part cavity when the die casting apparatus is closed, the cover die means having gate means therein for conveying molten casting material through the outer side of the cover die means into the interior of the carrier plate part cavity, the gate means being formed such that after a part has been cast, solidified material forming a runner system leading to the cast part can be broken from the cast part by axially moving the cast part away from the runner system;

a runner plate mounted on the fixed plate between the fixed plate and the outer side of the cover die means, the runner plate including runner cavity means in the surface thereof for conveying molten material under pressure along the outer side of the cover die means to the gate means for injection into the part cavity when the die casting apparatus is closed;

ejector die means for covering the other open end of the part cavity in the carrier plate when the carrier plate is in the casting station, said ejector die means being mounted on the traveling plate;

means for moving the traveling plate between open and closed positions so as to open and close the die casting apparatus, the runner plate, cover die, carrier plate, and ejector die all being pressed together when the die casting apparatus is closed, such that molten material injected into the runner conduits under pressure is conveyed into the interior of the part cavity, the traveling plate being moved outwardly a third predetermined distance in moving from its closed to its open position;

means for injecting molten material into the part cavity through the runner cavities and gate means when the die casting apparatus is closed;

cover die operating cylinder means for moving the cover die means outwardly from the runner plate after the completion of a casting operation so as to expose the runner system and break the runner system from the cast part at the gate means, the cover die means and runner plate being formed such that the runner system remains attached to the runner plate when the cover die means is moved away from the runner plate, the cover die operating cylinder means keeping the cover die means pressed against the carrier plate means as the traveling plate moves away from the fixed plate, the cover die operating cylinder means stopping the outward movement of the cover die means after it is moved outwardly a first predetermined distance, said first predetermined distance being shorter than said third predetermined distance, movement of the traveling plate beyond said first predetermined distance serving to remove the cover die from the cast part and carrier plate;

ejector die ejector means for stopping outward movement of the carrier plate means after the carrier plate means has moved outwardly a second predetermined distance, the second predetermined distance being greater than the first predetermined distance but less than the third predetermined distance, movement of the traveling plate past said second predetermined distance serving to separate the ejector die means from the cast part and carrier plate means, leaving the carrier plate means free for movement to a subsequent station; and runner ejector means for dislodging the runner system from the runner plate after the cover die means has moved away from the cover plate.

2. Die casting apparatus according to claim 1 wherein the runner plate is mounted in a fixed position with respect to the fixed plate, and the runner ejector means comprises an axially movable runner ejector plate positioned between the runner plate and the fixed plate, runner ejector pins being attached to the runner ejector plate and extending through openings in the runner plate into position to engage the runner system retained in the runner plate, the runner ejector means further comprising means for moving the runner ejector plate outwardly when the cover die means is moved away from the runner plate so as to cause the runner ejector pins to engage and dislodge outwardly the runner system from the runner plate.

3. Die casting apparatus according to claim 2 wherein the cover die operating cylinder means includes an extension shaft that passes through the runner plate and runner ejector plate and is attached to the cover die means, the extension shaft including a shoulder thereon that is positioned to engage the runner plate after the cover die means has moved away from the runner plate, further movement of the extension shaft is an outward direction causing the runner ejector plate to move outwardly along with the cover die so as to dislodge the runner system from the runner plate, the runner ejector means further including means for returning the runner ejector plate to its original position when the runner system has been dislodged and the cover die means is returned to its position in engagement with the runner plate.

4. Die casting apparatus according to claim 3 wherein the means for injecting molten material into the part cavity includes a shot chamber having inlet means for receiving molten material and outlet means in the end thereof for injecting molten material into the part cavity through the runner cavities and gate means, the shot chamber outlet means being positioned adjacent the back of the cover die means when the die casting apparatus is closed, ram means being reciprocably mounted in the shot chamber for discharging the molten material under pressure from said shot chamber outlet means, the ram means being operated by shot cylinder means, the shot cylinder means stopping movement of the ram means short of the cover die means in casting the part, leaving a biscuit of cast material at the outlet end of said shot chamber, the shot cylinder means causing the ram means to move further outwardly after the cover die means has moved away from the runner plate so as to eject the biscuit from the outlet means of the shot chamber.

5. Die casting apparatus according to claim 1 wherein the ejector die means includes compensating means for adjusting the height of the die to provide for the casting of parts having different thicknesses without having to change the die, said compensating means comprising:

a fixed ejector die element mounted in a fixed position with respect to the traveling plate, the fixed ejector die element having an axial ejector die cavity therein that mates with the open end of the carrier plate;

a movable ejector die element that fits in the ejector die cavity and is movable in an axial direction therein to enlarge or reduce the depth of the ejector die cavity; and compensating cylinder means mounted in a fixed position with respect to the traveling plate and attached to the movable ejector die element for moving the ejector die element axially in the ejector die cavity.

6. Die casting apparatus according to claim 5 where the ejector die ejector means comprises:

at least one ejector pin slidably mounted in an axial opening in the movable ejector die element such that the ejector pin can slide through the movable ejector die element into contact with the cast part, said ejector pin normally being carried with the ejector die and traveling plate as they move outwardly;

means for stopping the outward movement of the ejector pin at a fixed axial position after the traveling plate has moved outwardly the second predetermined distance, engagement of the ejector pin with the cast part causing the carrier plate to remain in a fixed position at that point, permitting the traveling plate and ejector die to be separated from the carrier plate and cast part, said ejector die ejector means further including means for thereafter retracting the ejector pin into the movable ejector die element and away from the carrier plate after the traveling plate and ejector die have moved away from the cast part and carrier plate so as to separate the carrier plate and cast part from the ejector pin for movement to a subsequent station.

7. Die casting apparatus according to claim 6 wherein:

the ejector pin is attached at an inner end to an ejector plate that is positioned behind the movable ejector die element for axial movement with respect thereto, an outer end of the ejector pin extending into the axial opening in the movable ejector die element, the ejector plate being resiliently urged to a retracted position with respect to the movable ejector die element such that the ejector pin normally does not protrude into the ejector die cavity, the ejector plate being axially movable along with the movable ejector die element when the compensating cylinder means is employed for adjusting the height of the die;

at least one bumper pin slidably fits through openings in the traveling plate, a forward end of said bumper pin being positioned adjacent the ejector plate for engagement therewith, a rear end of the bumper pin extending outwardly through the other side of the traveling plate; and a bumper plate is positioned on the opposite side of the traveling plate from the die assembly, said bumper plate having an extended and retracted position, the extended position being such that the bumper plate engages the bumper pin and causes the bumper pin to engage the ejector plate after the traveling plate has moved outwardly by said second predetermined distance, the engagement of the bumper pin with the ejector plate causing the outward movement of the carrier plate and cast part to be stopped by the ejector pin after they have moved outwardly said second predetermined distance, the traveling plate thereafter continuing to move outwardly to the third predetermined distance, the bumper plate being retractable to a retracted position so as to permit the ejector pins and ejector plate to return to their original retracted positions after the ejector die means has moved away from the carrier plate means.

8. Die casting apparatus according to claim 5 wherein the carrier plate means includes part cavities for at least two separate parts, the cover die means and runner plate being formed to accommodate both parts, and the ejector die means including separate ejector die cavities and separate movable ejector die elements and compensating cylinder means for each part cavity, such that individual die size adjustment can be made for each part cavity.

9. Die casting apparatus according to claim 1 wherein the gate means includes pin-point gate means comprising at least one inwardly tapered opening extending through the outer side of the cover die means to the interior of the part cavity, the opening including a narrow neck adjacent the interior of the part cavity such that the runner system is broken from the cast part at the neck by axial separation of the runner and cast part.

10. Die casting apparatus according to claim 1 wherein:

the apparatus is fabricated so as to cast rotors or other such parts that include a stack of laminations temporarily connected together by a skew pin, wherein molten material is injected into the stack of laminations to form a cast part incorporating the stacked laminations;

the indexing means rotates the parts through six separate stations spaced equal radial distances around the axis of the indexing means, the stations respectively being a loading station, which includes means for loading part bodies into the part cavities in the carrier plate means; a casting station; two cooling stations; a skew pin eject station including means for ejecting the skew pins from the cast parts; and an unloading station including means for removing cast parts from the machine, the carrier plate means including sufficient part cavities to position parts at all six stations simultaneously.

11. Die casting apparatus according to claim 1 wherein the die casting apparatus is a three tie bar horizontally disposed die casting machine, with the fixed plate and movable plate being disposed vertically for movement in a horizontal direction, two of the three tie bars being disposed along one vertical edge of the plates and a third tie bar being positioned approximately in the center of the plates, the indexing mechanism being rotatably mounted on the third tie bar for movement of the carrier plate radially to separate stations.

12. Die casting according to claim 11 wherein the die casting apparatus further includes a back plate axially aligned with the other plates and connected to the other plates by the tie bars, the traveling plate being reciprocably mounted between the fixed and back plates, the means for reciprocating the traveling plate with respect to the fixed plate including toggle linkage means extending between the back and the traveling plates, the toggle linkage means having a locked position wherein the traveling plate is extended toward the fixed plate and the die casting apparatus is closed, the toggle linkage means having a retracted position wherein the traveling plate is retracted and the die casting apparatus is opened, the casting station of the die casting apparatus being approximately centered between the tie bars and the tie bars being spaced outwardly on the plates from the casting station, the toggle linkage means including separate toggle linkages for each tie bar positioned adjacent the tie bar and between the tie bar and the axis of the casting station, each toggle linkage being pivotally attached to the traveling plate and back plate for pivotal movement in the plane extending between the axis of the tie bar and the axis of the casting station, the toggle linkage being attached to the traveling plate at a position inward on said plane from the position of attachment of the toggle linkage on the back plate, such that the toggle linkage, when locked, is inclined inwardly toward the axis of the casting station as it extends from the back to the travel plate.

13. In a die casting machine wherein a part is conveyed to and from a casting station between two opposed plates that are relatively movable with respect to each other in an axial direction to open and close a die assembly holding the part, and wherein molten material is injected into the part from the outlet of a shot chamber when the die assembly is closed, producing a cast part and an attached runner system of cast material leading from the shot chamber to the cast part, and wherein one of the plates is thereafter retracted with respect to the other to open the die assembly, the improvement comprising:

carrier plate means for conveying the part to and from the casting station, said carrier plate means having an internal part cavity for carrying the part, with the part cavity having open ends facing the two opposed plates, the carrier plate being axially movable with respect to the two plates;

cover die means mounted on a first plate of the two plates for covering one of the open ends of the carrier plate means when the die assembly is closed, the cover die means having gate means therein for admitting molten material through the cover die means to the interior of the part cavity;

runner plate means mounted between the cover die means and the first plate, the runner plate means having runner cavity means in the surface thereof facing the cover die means such that when the die assembly is closed, the cover die means and runner plate means are in engagement and the runner cavity means provides a conduit for conveying molten material from the outlet of the shot cylinder to the interior of the part cavity through the gate means of the cover die means, the cover die means being relatively movable in an axial direction with respect to the runner plate means;

ejector die means attached to a second of the two plates for covering the other open end of the carrier plate means when the die assembly is closed, the ejector die means being movable along with the second plate when the second plate moves relative to the first plate;

means for axially moving the second plate relative to the first plate between retracted and extended positions, the die assembly being opened when the second plate is retracted and closed when the second plate is extended, the runner plate, cover die, carrier plate, and ejector die being pressed together when the die assembly is closed so as to enclose the part cavity and provide a closed conduit from the shot cylinder to the part cavity;

separating means for axially separating the carrier plate means and cast part carried thereby from the runner system, cover die means, and ejector die means as the second plate is retracted, while the cast part remains in the casting station, the separation being sufficient to free the carrier plate and cast part for movement away from the casting station while leaving the cover die means and ejector die means at the casting station, said separating means also axially separating the cover die means from the runner plate means at the same time; and runner ejector means for ejecting solidified cast material formed in the runner cavities and at the outlet of the shot chamber from the die assembly while the cover plate means is separated from the runner plate.

14. A die casting machine according to claim 13 wherein the separating means first separates the cover die means from the runner plate means, then separates the cover die means from the carrier plate means, and finally separates the ejector die means from the carrier plate means.

15. A die casting machine according to claim 14 wherein:

the cover die means is axially movable with respect to the first plate, and the runner plate means is in a fixed position with respect to the first plate;

the separating means includes means for keeping the cover die means pressed against the carrier plate and moving the cover die means outwardly as the second plate begins to retract so as to separate the cover die means from the runner plate means;

the cover die means and runner plate means are formed such that when the cover die means is axially separated from the runner plate means the runner system breaks from the cast part and remains in the runner cavity means; and the runner ejector means comprises a runner ejector plate mounted between the runner plate means and the first plate for axial movement with respect thereto, the runner ejector plate having runner ejector pins extending therefrom in alignment with openings in the runner plate means leading to the back of the runner system, the runner ejector means further including means for moving the runner ejector plate outwardly such that the runner ejector pins engage and dislodge the runner system from the runner cavities when the cover die means is separated from the runner plate means.

16. A die casting machine according to claim 15 wherein the means for moving the cover die means outwardly comprises operating cylinder means having an extendible extension shaft attached to the cover die means for moving the cover die means, said extension shaft including shoulder means that engages and moves the runner ejector plate outwardly after the cover die means has moved outwardly a distance sufficient to permit the runner system to be ejected between the runner plate means and cover die means.

17. A die casting machine according to claim 16 wherein molten material is injected into the part by means of a ram reciprocably mounted in the shot chamber, the outlet of the shot chamber being positioned adjacent the cover die means when the die assembly is closed, the ram initially being extended to a point short of the cover die means when the cast part is formed, such that a solid biscuit remains at the outlet of the shot chamber after the part is cast, the solid biscuit being attached to the rest of the runner system, the ram extending outwardly a further distance after the cover die means moves away from the runner plate means and before ejection of the runner system from the runner cavities to eject the biscuit from the outlet of the shot cylinder.

18. A die casting machine according to claim 13 wherein the part is a rotor body comprising a stack of aligned laminations connected together by a skew pin inserted through an axial opening through the laminations, the rotor body being formed for casting metal connector bars in the laminations and metal end rings on each end of the stack, the carrier plate positioning the rotor body with its axis parallel to the axial direction of movement of the plates and die assembly, the gate means comprising inwardly tapered openings extending through the back of the cover die means to the interior of the part cavity, the openings being formed such that molten material injected into the part cavity flows through the opening in the same general direction that the material flows in forming the connector bars in the part cavity.

19. A die casting machine according to claim 13 wherein the ejector die means includes compensating means for adjusting the height of the die assembly to provide for the casting of parts having different thicknesses without having to change the die assembly, said compensating means comprising:

a fixed ejector die element mounted in a fixed position with respect to the second plate, the fixed ejector die element having an axial ejector die cavity therein that mates with the open end of the carrier plate means;

a movable ejector die element that fits in the ejector die cavity and is movable in an axial direction therein to enlarge or reduce the dept of the ejector die cavity; and compensating cylinder means mounted in a fixed position with respect to the second plate and attached to the movable ejector die element for moving the ejector die element in the ejector die cavity.

20. A die casting machine according to claim 19 where the separating means comprises:

means for separating the cast part from the cover die means after the second plate has retracted a first predetermined distance from its closed position;

at least one ejector pin slidably mounted in an axial opening in the movable ejector die element such that the ejector pin can slide through the movable ejector die element into contact with the cast part, said ejector pin normally being carried with the ejector die and second plate as they move outwardly;

means for stopping the outward movement of the ejector pin at a fixed axial position after the second plate has moved outwardly a second predetermined distance that is greater than said first predetermined distance, engagement of the ejector pin with the cast part causing the carrier plate means to remain in a fixed position at that point, permitting the second plate and ejector die means to be separated from the carrier plate means and cast part, said separating means further including means for thereafter retracting the ejector pin into the movable ejector die element and away from the carrier plate means after the second plate and ejector die means have moved away from the cast part and carrier plate means so as to separate the carrier plate means and cast part from the ejector pin for movement to a subsequent station.

21. A die casting machine according to claim 20 wherein:

the ejector pin is attached at an inner end to an ejector plate that is positioned behind the movable ejector die element for axial movement with respect thereto, an outer end of the ejector pin extending into the axial opening in the movable ejector die element, the ejector plate being resiliently urged to a retracted position with respect to the movable ejector die element such that the ejector pin normally does not protrude into the ejector die cavity, the ejector plate being axially movable along with the movable ejector die element when the compensating cylinder means is employed for adjusting the height of the die;

at least one bumper pin slidably fits through openings in the second plate, a forward end of said bumper pin being positioned adjacent the ejector plate for engagement therewith, a rear end of the bumper pin extending outwardly through the other side of the second plate; and a bumper plate is positioned on the opposite side the second plate from the die assembly, said bumper plate having an extended and retracted position, the extended position being such that the bumper plate engages the bumper pin and causes the bumper pin to engage the ejector plate after the second plate has moved outwardly by said second predetermined distance, the engagement of the bumper pin with the ejector plate causing the outward movement of the carrier plate means and cast part to be stopped by the ejector pin after they have moved outwardly said second predetermined distance, the second plate thereafter continuing to move outwardly to a fully retracted position a third predetermined distance from its closed position, the bumper plate being retractable to a retracted position so as to permit the ejector pins and ejector plate to return to their original retracted positions after the ejector die means has moved away from the carrier plate means.

22. A die casting machine according to claim 19 wherein the carrier plate means includes part cavities for at least two separate parts, the cover die means and runner plate means being formed to accommodate both parts, and the ejector die means including separate ejector die cavities and separate movable ejector die elements and compensating cylinder means for each part cavity, such that individual die size adjustment can be made for each part cavity.

23. Die casting apparatus according to claim 13 wherein the gate means includes pin-point gate means comprising at least one inwardly tapered opening extending through the outer side of the cover die means to the interior of the part cavity, the opening including a narrow neck adjacent the interior of the part cavity such that the runner system is broken from the cast part at the neck by axial separation of the runner and cast part.

24. In a molding machine including opposed front and back plates and an axially reciprocable traveling plate mounted between them for opening and closing a die assembly mounted between the traveling plate and front plate, a plurality of spaced, axially disposed tie bars interconnecting the plates, the die assembly being approximately centered with respect to the tie bars and approximately equidistant from each tie bar, a toggle linkage mechanism extending between the back plate and traveling plate for reciprocating the traveling plate to open and close the die assembly, the toggle linkage mechanism including a separate toggle linkage for each tie bar positioned adjacent each tie bar between the tie bar and the axis of the die assembly, the improvement wherein each toggle linkage comprises anchor means for attaching the toggle linkage to the opposing faces of the back plate and traveling plate for pivotal movement approximately in the plane extending between the tie bar and the axis of the die assembly, the anchor means on the traveling plate being positioned inwardly along said plane with respect to the position of the anchor means on the back plate, such that the toggle linkage is inclined inwardly with respect to the axis of the tie bar in extending from the back plate to the traveling plate.

25. A molding machine according to claim 24 wherein the machine employs three tie bars equally spaced around the axis of the die assembly, and the angle of inclination of each toggle linkage is about 10° when the die assembly is closed.

* * * * *